US012790695B2

(12) United States Patent
Kawamura et al.

(10) Patent No.: US 12,790,695 B2
(45) Date of Patent: Nov. 10, 2026

(54) CAN STEEL SHEET AND METHOD FOR PRODUCING SAME

(71) Applicant: JFE Steel Corporation, Tokyo (JP)

(72) Inventors: Yuto Kawamura, Tokyo (JP); Yusuke Nakagawa, Tokyo (JP); Yoichiro Yamanaka, Tokyo (JP); Jialin Wang, Tokyo (JP); Shuhei Kozu, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 407 days.

(21) Appl. No.: 18/272,148

(22) PCT Filed: Nov. 15, 2021

(86) PCT No.: PCT/JP2021/041946
§ 371 (c)(1),
(2) Date: Jul. 13, 2023

(87) PCT Pub. No.: WO2022/163073
PCT Pub. Date: Aug. 4, 2022

(65) Prior Publication Data

US 2024/0141504 A1 May 2, 2024

(30) Foreign Application Priority Data

Jan. 27, 2021 (JP) ..... 2021-011355

(51) Int. Cl.
*C23C 28/00* (2006.01)
*C23C 22/37* (2006.01)
(Continued)

(52) U.S. Cl.
CPC ..... *C23C 28/32* (2013.01); *C23C 22/37* (2013.01); *C23C 28/345* (2013.01); *C25D 3/08* (2013.01);
(Continued)

(58) Field of Classification Search
None
See application file for complete search history.

(56) References Cited

U.S. PATENT DOCUMENTS

2017/0334170 A1* 11/2017 Haghdoost ..... B32B 15/04
2018/0355496 A1* 12/2018 Nakagawa ..... C25D 5/605
(Continued)

FOREIGN PATENT DOCUMENTS

CN 101928966 A 12/2010
JP 6254096 A 3/1987
(Continued)

OTHER PUBLICATIONS

International Search Report and Written Opinion for International Application No. PCT/JP2021/041946, dated Jan. 25, 2022, 6 pages.
(Continued)

*Primary Examiner* — Seth Dumbris
(74) *Attorney, Agent, or Firm* — Buchanan Ingersoll & Rooney PC

(57) ABSTRACT

There is provided a steel sheet for cans including, on a surface of a steel sheet, a chromium metal layer and a hydrated chromium oxide layer stacked in this order from the steel sheet side. The chromium metal layer has a coating weight of 50 to 200 mg/m$^2$, and the hydrated chromium oxide layer has a coating weight of 3 to 30 mg/m$^2$ in terms of chromium amount. The chromium metal layer includes a base portion of flat plate shape and granular protrusions provided on the base portion. At least 20% of the granular protrusions has a circularity C of 0.85 or less. The circularity C is expressed by $C=4\pi A/U^2$, when the outer perimeter of a projection image of a granular protrusion is represented by U, and the area thereof is represented by A.

22 Claims, 1 Drawing Sheet

(51) Int. Cl.

| | |
|---|---|
| ***C25D 3/08*** | (2006.01) |
| ***C25D 5/00*** | (2006.01) |
| ***C25D 5/36*** | (2006.01) |
| ***C25D 7/06*** | (2006.01) |
| ***C25D 9/06*** | (2006.01) |
| ***C25D 9/10*** | (2006.01) |
| ***C25D 11/38*** | (2006.01) |

(52) U.S. Cl.
CPC ..... *C25D 5/36* (2013.01); *C25D 5/605* (2020.08); *C25D 7/0614* (2013.01); *C25D 9/06* (2013.01); *C25D 9/10* (2013.01); *C25D 11/38* (2013.01)

(56) References Cited

U.S. PATENT DOCUMENTS

| | | | | |
|---|---|---|---|---|
| 2018/0363160 | A1* | 12/2018 | Nakagawa ..... | C25D 7/0614 |
| 2020/0141021 | A1 | 5/2020 | Nakagawa et al. | |
| 2020/0149179 | A1 | 5/2020 | Nakagawa et al. | |

FOREIGN PATENT DOCUMENTS

| | | | |
|---|---|---|---|
| JP | 0246678 | B2 | 10/1990 |
| JP | 03229897 | A | 10/1991 |
| JP | 2020117748 | A | 8/2020 |
| JP | 2020-200533 | A | 12/2020 |
| WO | 2018225726 | A1 | 12/2018 |
| WO | 2018225739 | A1 | 12/2018 |

OTHER PUBLICATIONS

Japanese Concise Statement of Relevance of Office Action for Japanese Application No. 2022-506429, dated Aug. 2, 2022, with English translation, 5 pages.

Office Action (The First Office Action) issued Apr. 29, 2026, by the State Intellectual Property Office of People's Republic of China in corresponding Chinese Patent Application No. 202180091021.7 and an English translation of the Office Action. (17 pages).

* cited by examiner

CAN STEEL SHEET AND METHOD FOR PRODUCING SAME

CROSS REFERENCE TO RELATED APPLICATIONS

This is the U.S. National Phase application of PCT/JP2021/041946, filed Nov. 15, 2021, which claims priority to Japanese Patent Application No. 2021-011355, filed Jan. 27, 2021, the disclosures of these applications being incorporated herein by reference in their entireties for all purposes.

FIELD OF THE INVENTION

The present invention relates to a steel sheet for cans (tin mill black plate) and a method of manufacturing the same.

BACKGROUND OF THE INVENTION

Patent Literatures 1 and 2 disclose a steel sheet for cans comprising, "on a surface of a steel sheet, a chromium metal layer and a hydrated chromium oxide layer stacked in this order from a steel sheet side" with the chromium metal layer having "granular protrusions."

PATENT LITERATURE

Patent Literature 1: WO 2018/225739
Patent Literature 2: WO 2018/225726

SUMMARY OF THE INVENTION

While the steel sheets for cans as disclosed by Patent Literatures 1 and 2 have good weldability, further improvement in weldability has been required in recent years.

An object according to aspects of the present invention is therefore to provide a steel sheet for cans having excellent weldability and a method of manufacturing the same.

The inventors found, though an earnest study, that making granular protrusions in a specific shape leads to the achievement of the foregoing objection. Aspects of the invention have been thus completed.

Specifically, aspects of the present invention provide the following [1] to [9].

[1] A steel sheet for cans comprising, on a surface of a steel sheet, a chromium metal layer and a hydrated chromium oxide layer stacked in this order from a steel sheet side, wherein the chromium metal layer has a coating weight of 50 to 200 mg/m$^2$, the hydrated chromium oxide layer has a coating weight of 3 to 30 mg/m$^2$ in terms of chromium amount, the chromium metal layer includes a base portion of flat plate shape and granular protrusions provided on the base portion, and at least 20% of the granular protrusions has a circularity C of 0.85 or less, the circularity C being expressed by $C=4\pi A/U^2$, when an outer perimeter of a projection image of each of the granular protrusions is represented by U, and an area thereof is represented by A.

[2] The steel sheet for cans according to [1] above, wherein the granular protrusions have a maximum grain size of not more than 200 nm, and the granular protrusions have a number density of not less than 10 protrusions/μm$^2$.

[3] A method of manufacturing the steel sheet for cans according to [1] or [2] above, the method comprising:

subjecting the steel sheet to cathodic electrolysis treatment C1, anodic electrolysis treatment A1, and cathodic electrolysis treatment C2 in this order with use of a first aqueous solution, followed by anodic electrolysis treatment A2 and cathodic electrolysis treatment C3 with use of a second aqueous solution, wherein the first aqueous solution contains a hexavalent chromium compound, a fluorine-containing compound, and sulfuric acid, and the second aqueous solution contains a hexavalent chromium compound and a fluorine-containing compound and is free of sulfuric acid except for sulfuric acid inevitably incorporated therein.

[4] The method according to [3] above, wherein an electric quantity density of the anodic electrolysis treatment A2 is not more than 1.3 C/dm$^2$.

[5] A method of manufacturing the steel sheet for cans according to [1] or [2] above, the method comprising:

subjecting the steel sheet to cathodic electrolysis treatment C1, anodic electrolysis treatment A1, and cathodic electrolysis treatment C2 in this order with use of a first aqueous solution, followed by cathodic electrolysis treatment C3 with use of a second aqueous solution, wherein the first aqueous solution contains a hexavalent chromium compound, a fluorine-containing compound, and sulfuric acid, and the second aqueous solution contains a hexavalent chromium compound and a fluorine-containing compound and is free of sulfuric acid except for sulfuric acid inevitably incorporated therein.

[6] The method according to [5] above, wherein immersion treatment is carried out with use of the second aqueous solution after the cathodic electrolysis treatment C2 and before the cathodic electrolysis treatment C3.

[7] The method according to [6] above, wherein an immersion time of the immersion treatment is from 0.10 to 20.00 seconds.

[8] The method according to any one of [3] to [7] above, wherein a current density of the cathodic electrolysis treatment C3 is not less than 5.0 A/dm$^2$, and an electric quantity density of the cathodic electrolysis treatment C3 is not less than 3.5 C/dm$^2$.

[9] The method according to any one of [3] to [8] above, wherein an amount of F in the first aqueous solution is from 0.020 to 0.480 mol/L, and an amount of F in the second aqueous solution is from 0.010 to 0.053 mol/L.

Aspects of the present invention include a steel sheet for cans having excellent weldability and a method of manufacturing the same.

DETAILED DESCRIPTION OF EMBODIMENTS OF THE INVENTION

[Steel Sheet for Cans]

Figure 1:
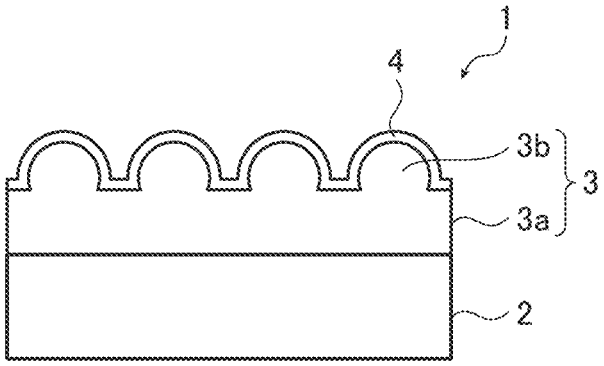
FIG. 1 is a cross-sectional view schematically showing one example of a steel sheet for cans.

FIG. 1 is a cross-sectional view schematically showing one example of a steel sheet for cans.

As shown in FIG. 1, a steel sheet 2 is included. A steel sheet for cans 1 further includes, on a surface of the steel sheet 2, a chromium metal layer 3 and a hydrated chromium oxide layer 4 stacked in this order from the steel sheet 2 side.

The chromium metal layer 3 includes a base portion 3*a* of flat plate shape covering the steel sheet 2, and granular protrusions 3*b* provided on the base portion 3*a*. The hydrated chromium oxide layer 4 is disposed on the chromium metal layer 3 to conform to the shape of the granular protrusions 3*b*.

The constituent elements of the steel sheet for cans are described in more detail below.

<Steel Sheet>

The type of a steel sheet is not particularly limited. In general, a steel sheet used as a material for a container (e.g., a low carbon steel sheet or an ultra-low carbon steel sheet) can be used. A method of manufacturing the steel sheet, a material thereof, and the like are also not particularly limited. The steel sheet is manufactured through a process starting with a typical billet manufacturing process, followed by such processes as hot rolling, pickling, cold rolling, annealing and temper rolling.

<Chromium Metal Layer>

A chromium metal layer is disposed on a surface of the foregoing steel sheet. The chromium metal layer reduces exposure of a surface of the steel sheet and thereby improves corrosion resistance.

<<Coating Weight>>

The coating weight of the chromium metal layer is not less than 50 mg/m$^2$, preferably not less than 60 mg/m$^2$, and more preferably not less than 70 mg/m$^2$ because this leads to excellent corrosion resistance of the steel sheet for cans. The coating weight refers to the coating weight per one side of the steel sheet (the same applied hereinafter).

In contrast, when the coating weight of the chromium metal layer is too large, high-melting chromium metal covers the entire surface of the steel sheet, and this may induce decrease in weld strength in welding and significant generation of dust, thus leading to poor weldability.

The coating weight of the chromium metal layer is not more than 200 mg/m$^2$, preferably not more than 180 mg/m$^2$, and more preferably not more than 160 mg/m$^2$ because this leads to excellent weldability of the steel sheet for cans.

(Measurement Methods of Coating Weights)

The coating weight of the chromium metal layer and the coating weight of a hydrated chromium oxide layer (described later) in terms of chromium amount are measured as follows.

First, for the steel sheet for cans having the chromium metal layer and the hydrated chromium oxide layer formed therein, the amount of chromium (total amount of chromium) is measured with an X-ray fluorescence device. Next, the steel sheet for cans is subjected to alkaline treatment, i.e., is immersed in 6.5N—NaOH at 90° C. for 10 minutes, and then, again, the amount of chromium (amount of chromium after alkaline treatment) is measured with an X-ray fluorescence device. The amount of chromium after alkaline treatment is taken as the coating weight of the chromium metal layer.

Thereafter, the equation (amount of alkali-soluble chromium)=(total amount of chromium)−(amount of chromium after alkaline treatment) is calculated, and the amount of alkali-soluble chromium is taken as the coating weight of the hydrated chromium oxide layer in terms of chromium amount.

The chromium metal layer as above includes a base portion of flat plate shape and granular protrusions provided on the base portion. Next, those portions included in the chromium metal layer are described in detail.

<<Base Portion>>

The base portion of the chromium metal layer mainly improves corrosion resistance by covering a surface of the steel sheet.

The base portion of the chromium metal layer preferably has a sufficient thickness such that the base portion is not destroyed by the granular protrusions provided in the surface layer, thus preventing the exposure of the steel sheet, when the steel sheet for cans inevitably comes into contact with another steel sheet for cans at handling.

The coating weight of the base portion of the chromium metal layer is preferably not less than 10 mg/m$^2$, more preferably not less than 30 mg/m$^2$, and even more preferably not less than 40 mg/m$^2$ because this leads to excellent corrosion resistance of the steel sheet for cans.

<<Granular Protrusions>>

The granular protrusions of the chromium metal layer are formed on a surface of the base portion described above and reduce contact resistance between to-be-welded portions of the steel sheet for cans, thereby improving weldability. An assumed mechanism of reduction in contact resistance is described below.

The hydrated chromium oxide layer covering the chromium metal layer is a non-conductive coating and therefore has higher electric resistance than chromium metal, so that the hydrated chromium oxide layer works as a factor hindering welding. By forming the granular protrusions on a surface of the base portion of the chromium metal layer, the granular protrusions act to destroy the hydrated chromium oxide layer using the surface pressure applied when to-be-welded portions of the steel sheet for cans come into contact with each other in welding, and the granular protrusions become current-carrying points of welding current, whereby the contact resistance greatly decreases.

(Circularity C)

At least 20% of the granular protrusions of the chromium metal layer has a circularity C of not more than 0.85. With this, the weldability of the steel sheet for cans improves more. In other words, the steel sheet for cans has excellent weldability.

The circularity C is expressed by $C=4\pi A/U^2$, when the outer perimeter of a projection image of a granular protrusion is represented by U, and the area thereof is represented by A. The circularity C represents a ratio between a square of the outer perimeter of a true circle whose area is A ($=4\pi^2r^2=4\pi A$) and a square of the outer perimeter U actually measured ($=U^2$), and should be 1.0 if it is a true circle. The more the shape deviates from a true circle, that is, the longer the outer perimeter is, the more the circularity C decreases.

One example of the shape of a granular protrusion with a circularity C of 0.85 or less is an angular shape.

Angular granular protrusions have many pointed parts compared to, for example, granular protrusions in a true circle shape, and therefore easily destroy the hydrated chromium oxide layer (or easily form a starting point of such destruction).

Thus, it is assumed that the steel sheet for cans has excellent weldability because of having many granular protrusions with a circularity C of 0.85 or less.

The proportion of granular protrusions with a circularity C of 0.85 or less is not less than 20% as describes above, and preferably not less than 40%, and more preferably not less than 60% because this leads to more excellent weldability of the steel sheet for cans.

Figure 2:
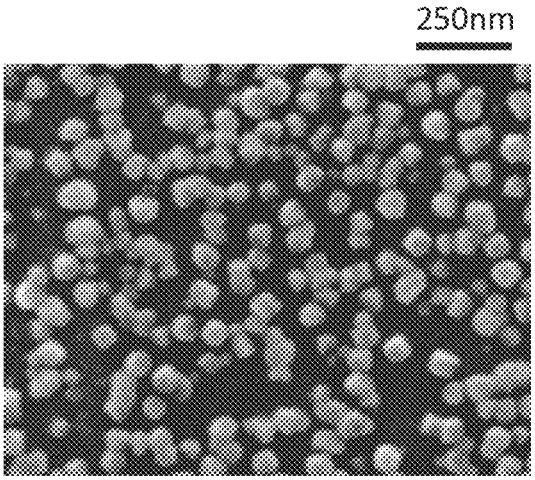
FIG. 2 is an SEM image showing granular protrusions of Comparative Example 1.
Figure 3:
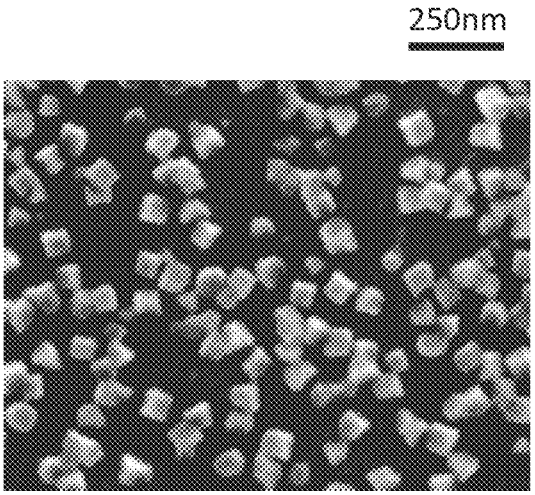
FIG. 3 is an SEM image showing granular protrusions of Inventive Example 3.

Now FIGS. 2 and 3 are presented as SEM images showing granular protrusions.

FIG. 2 is an SEM image showing granular protrusions of Comparative Example 1 to be described later, and FIG. 3 is an SEM image showing granular protrusions of Inventive Example 3 to be described later.

Referring to Table 4 provided below, the proportion of granular protrusions with a circularity C of 0.85 or less is 12% in FIG. 2 (Comparative Example 1) and 68% in FIG. 3 (Inventive Example 3).

Actually, more angular granular protrusions can be seen in the SEM image of FIG. 3 than in FIG. 2.

Hereinafter, granular protrusions with a circularity C of 0.85 or less is sometimes called "angular granular protrusions" for convenience. In addition, forming granular protrusions to have a circularity C of 0.85 or less is sometimes called "angulation."

(Maximum Grain Size)

As described above, the granular protrusions of the chromium metal layer destroy a hydrated chromium oxide layer, thereby reducing contact resistance and improving weldability. Accordingly, the maximum grain size of the granular protrusions of the chromium metal layer is, for instance, not less than 10 nm.

The maximum grain size of the granular protrusions of the chromium metal layer is preferably not less than 50 nm, more preferably not less than 80 nm, and even more preferably not less than 140 nm because this leads to more excellent weldability of the steel sheet for cans.

On the other hand, the maximum grain size of the granular protrusions of the chromium metal layer is preferably not more than 200 nm and more preferably not more than 180 nm because this leads to excellent surface appearance of the steel sheet for cans. This is probably because the granular protrusions with a smaller grain size serve to suppress absorption of short-wavelength light and suppress dispersion of reflected light.

(Number Density)

A larger number of the granular protrusions of the chromium metal layer increases the number of current-carrying points, thereby leading to excellent weldability. Accordingly, the number density of the granular protrusions of the chromium metal layer is preferably not less than 10 protrusions/$\mu m^2$, more preferably not less than 30 protrusions/$\mu m^2$, even more preferably not less than 50 protrusions/$\mu m^2$, and particularly preferably not less than 100 protrusions/$\mu m^2$.

On the other hand, the number density of the granular protrusions of the chromium metal layer is preferably not more than 10,000 protrusions/$\mu m^2$, more preferably not more than 5,000 protrusions/$\mu m^2$, even more preferably not more than 1,000 protrusions/$\mu m^2$, and particularly preferably not more than 800 protrusions/$\mu m^2$ because this leads to an excellent surface appearance of the steel sheet for cans.

(Methods of Measuring Circularity C, Number Density, and Maximum Grain Size)

The circularity C, the number density, and the maximum grain size of the granular protrusions are determined by the following methods.

First, a surface of the steel sheet for cans having the chromium metal layer and a hydrated chromium oxide layer formed thereon is subjected to carbon deposition to prepare an observation sample. Next, the observation sample is observed from a vertical direction with respect to the surface of the steel sheet for cans with a scanning electron microscope (SEM) to obtain SEM images (projection images of granular protrusions) at a magnification of 20,000×. The obtained SEM images are subjected to image analysis using software (trade name: ImageJ).

For each granular protrusion included in the SEM images, the outer perimeter U and the area A are determined, and the circularity C is calculated using the equation of $C=4\pi A/U^2$. Thereafter, the proportion (unit: %) of granular protrusions with a circularity C of 0.85 or less is obtained. The proportion is the average of values of five fields.

Further, for the obtained SEM image, the grain sizes (unit: nm) and the number density (unit: protrusions/$\mu m^2$) of the granular protrusions are obtained based on the area occupied by the granular protrusions, with the granular protrusions being treated as true circles. The maximum grain size in the five fields is taken as the maximum grain size of the granular protrusions. The number density is the average of values of the five fields.

<Hydrated Chromium Oxide Layer>

A hydrated chromium oxide is deposited along with chromium metal on a surface of the steel sheet and is to improve corrosion resistance. The hydrated chromium oxide contains, for example, a chromium oxide and a chromium hydroxide.

<<Coating Weight>>

The coating weight of the hydrated chromium oxide layer in terms of chromium amount is not less than 3 mg/$m^2$, preferably not less than 10 mg/$m^2$, and even preferably more than 15 mg/$m^2$ for the purpose of ensuring corrosion resistance of the steel sheet for cans.

Meanwhile, a hydrated chromium oxide has low conductivity compared to chromium metal, and accordingly, too much amount of hydrated chromium oxide leads to excessive resistance in welding, which may cause generation of dust, occurrence of splash, and a variety of weld defects such as blowhole formation associated with overwelding, thus resulting in poor weldability of the steel sheet for cans.

The coating weight of the hydrated chromium oxide layer in terms of chromium amount is not more than 30 mg/$m^2$, preferably not more than 25 mg/$m^2$, and more preferably not more than 20 mg/$m^2$ because this leads to excellent weldability of the steel sheet for cans.

The measurement method of the coating weight of the hydrated chromium oxide layer in terms of chromium amount is as described above.

[Method of Manufacturing Steel Sheet for Cans]

Next, a method of manufacturing the foregoing steel sheet for cans is described.

Generally, a steel sheet is subjected to a first treatment (cathodic electrolysis treatment C1, anodic electrolysis treatment A1, and cathodic electrolysis treatment C2) with use of a first aqueous solution containing sulfuric acid, followed by a second treatment with use of a second aqueous solution free of sulfuric acid.

It is assumed that, first, the chromium metal layer (the base portion and the granular protrusions) and the hydrated chromium oxide layer are generated by the first treatment, and then, the granular protrusions are angulated by the second treatment. The second treatment has two embodiments (a first embodiment and a second embodiment).

Each deposition amount can be controlled by conditions for each treatment.

The respective treatments are separately described below in detail.

<First Treatment>

As the first treatment, a steel sheet is subjected to the cathodic electrolysis treatment C1, the anodic electrolysis treatment A1, and the cathodic electrolysis treatment C2 in this order with use of the first aqueous solution.

<<First Aqueous Solution>>

The first aqueous solution contains a hexavalent chromium compound, a fluorine-containing compound, and sulfuric acid.

(Hexavalent Chromium Compound)

Examples of the hexavalent chromium compound include chromium trioxide ($CrO_3$), dichromates such as potassium dichromate ($K_2Cr_2O_7$), and chromates such as potassium chromate ($K_2CrO_4$).

The amount of Cr in the first aqueous solution is preferably not less than 0.14 mol/L and more preferably not less than 0.30 mol/L. At the same time, the amount of Cr is preferably not more than 3.00 mol/L and more preferably not more than 2.50 mol/L.

(Fluorine-Containing Compound)

Examples of the fluorine-containing compound include hydrofluoric acid (HF), potassium fluoride (KF), sodium fluoride (NaF), hydrosilicofluoric acid ($H_2SiF_6$) and/or salts thereof. Examples of salts of hydrosilicofluoric acid include sodium silicofluoride ($Na_2SiF_6$), potassium silicofluoride ($K_2SiF_6$), and ammonium silicofluoride ($(NH_4)_2SiF_6$).

The amount of F in the first aqueous solution is preferably not less than 0.020 mol/L and more preferably not less than 0.080 mol/L. At the same time, the amount of F is preferably not more than 0.480 mol/L and more preferably not more than 0.400 mol/L.

(Sulfuric Acid)

The use of sulfuric acid in combination with the fluorine-containing compound improves adhesion efficiency of the chromium metal layer.

When the sulfuric acid content (the amount of $SO_4^{2-}$) falls within the range stated below, the grain sizes of the granular protrusions to be deposited in the cathodic electrolysis treatment C2 can be easily controlled to an appropriate range.

In addition, sulfuric acid also influences the formation of generation sites where the granular protrusions of the chromium metal layer are generated in the anodic electrolysis treatment. When the sulfuric acid content (the amount of $SO_4^{2-}$) falls within the range stated below, this prevents the granular protrusions from being excessively fine or coarse, and the proper number density can be achieved more easily.

When the grain sizes of the granular protrusions are too small or the number density of the granular protrusions are too low, current does not concentrate to the granular protrusions, so that the angulation of the granular protrusions is hard to proceed even through the second treatment. To cope with it, sulfuric acid is contained in the first aqueous solution to control the grain sizes and the number density of the granular protrusions.

Part of or all of sulfuric acid may be sulfate such as sodium sulfate, calcium sulfate, and ammonium sulfate.

The amount of $SO_4^{2-}$ in the first aqueous solution is preferably not less than 0.0001 mol/L, more preferably not less than 0.0003 mol/L, and even more preferably not less than 0.0010 mol/L.

At the same time, the amount of $SO_4^{2-}$ in the first aqueous solution is preferably not more than 0.1000 mol/L and more preferably not more than 0.0500 mol/L.

It is preferable that one type of aqueous solution be solely used in the first treatment (cathodic electrolysis treatment C1, anodic electrolysis treatment A1, and cathodic electrolysis treatment C1).

The first aqueous solution has a solution temperature of preferably not lower than 20° C. and more preferably not lower than 40° C. At the same time, the solution temperature is preferably not higher than 80° C. and more preferably not higher than 60° C.

<<Cathodic Electrolysis Treatment C1>>

The cathodic electrolysis treatment C1 is carried out to deposit chromium metal and a hydrated chromium oxide.

The electric quantity density (the product of the current density and the current application time) in the cathodic electrolysis treatment C1 is preferably not less than 15 C/dm$^2$, more preferably not less than 20 C/dm$^2$, and even more preferably not less than 25 C/dm$^2$ for the purpose of achieving a proper amount of deposition. At the same time, the electric quantity density in the cathodic electrolysis treatment C1 is preferably not more than 50 C/dm$^2$, more preferably not more than 45 C/dm$^2$, and even more preferably not more than 35 C/dm$^2$.

The current density (unit: A/dm$^2$) and the current application time (unit: sec.) in the cathodic electrolysis treatment C1 are appropriately set based on the foregoing electric quantity density.

<<Anodic Electrolysis Treatment A1>>

The anodic electrolysis treatment A1 dissolves chromium metal deposited in the cathodic electrolysis treatment C1 to form generation sites of the granular protrusions of the chromium metal layer to be generated in the cathodic electrolysis treatment C2.

When the dissolution excessively proceeds or the dissolution is too weak in the anodic electrolysis treatment A1, this may cause a decreased number of generation sites and hence a lower number density of the granular protrusions, a variation in distribution of the granular protrusions due to uneven progress of dissolution, and a smaller thickness of the base portion of the chromium metal layer.

In view of the foregoing factors, the electric quantity density (the product of the current density and the current application time) in the anodic electrolysis treatment A1 is preferably not less than 0.1 C/dm$^2$, more preferably not less than 0.3 C/dm$^2$, and even more preferably more than 0.3 C/dm$^2$. At the same time, the electric quantity density in the anodic electrolysis treatment A1 is preferably less than 5.0 C/dm$^2$, more preferably not more than 3.0 C/dm$^2$, and even more preferably not more than 2.0 C/dm$^2$.

The current density (unit: A/dm$^2$) and the current application time (unit: sec.) in the anodic electrolysis treatment A1 are appropriately set based on the foregoing electric quantity density.

<<Cathodic Electrolysis Treatment C2>>

As described above, cathodic electrolysis treatment allows chromium metal and a hydrated chromium oxide to be deposited. In particular, the cathodic electrolysis treatment C2 allows the granular protrusions of the chromium metal layer to be generated at the foregoing generation sites serving as starting points. In this process, when the electric quantity density is too high, the granular protrusions of the chromium metal layer may excessively grow, leading to a coarse grain size.

For this reason, the current density of the cathodic electrolysis treatment C2 is preferably less than 60.0 A/dm$^2$, more preferably less than 50.0 A/dm$^2$, and even more preferably less than 40.0 A/dm$^2$. At the same time, the current density of the cathodic electrolysis treatment C2 is preferably not less than 10 A/dm$^2$ and more preferably more than 15.0 A/dm$^2$.

For the same reason as above, the electric quantity density (the product of the current density and the current application time) of the cathodic electrolysis treatment C2 is preferably less than 30.0 C/dm$^2$ and more preferably not more than 25.0 C/dm$^2$. At the same time, the electric quantity density of the cathodic electrolysis treatment C2 is preferably not less than 1.0 C/dm$^2$ and more preferably not less than 2.0 C/dm$^2$.

The current application time (unit: sec.) in the cathodic electrolysis treatment C2 is appropriately set based on the foregoing electric quantity density.

The cathodic electrolysis treatment C1, the anodic electrolysis treatment A1, and the cathodic electrolysis treatment C2 need not be continuous electrolysis treatment. In other words, the treatments may be intermittent electrolysis treatment in which electrolysis is carried out separately for each set of electrodes in industrial production and, accordingly, an immersion time with no current application is inevitably present. In the case of intermittent electrolysis treatment, the total electric quantity density preferably falls within the foregoing range.

<Second Treatment (First Embodiment)>

In the second treatment (first embodiment), the steel sheet having undergone the first treatment is subjected to an anodic electrolysis treatment A2 and a cathodic electrolysis treatment C3 in this order with use of a second aqueous solution.

In the second treatment, current is concentrated to the granular protrusions deposited in the first treatment. Accordingly, an electrolytic reaction of the second treatment proceeds on the granular protrusions.

First, in the anodic electrolysis treatment A2, the granular protrusions deposited in the cathodic electrolysis treatment C2 are dissolved to form starting points of angulation of the granular protrusions to be carried out in the subsequent cathodic electrolysis treatment C3. Then, the cathodic electrolysis treatment C3 is carried out, whereby chromium metal is deposited depending on the crystallographic orientation of the granular protrusions, and the granular protrusions are angulated.

<<Second Aqueous Solution>>

The second aqueous solution contains a hexavalent chromium compound and a fluorine-containing compound and is free of sulfuric acid except for sulfuric acid inevitably incorporated therein.

If sulfuric acid is contained, the dissolution excessively proceeds, and the crystallographic orientation dependence of the deposition of chromium metal on the granular protrusions is not kept, so that the granular protrusions are not angulated even through the cathodic electrolysis treatment C3. Therefore, the second aqueous solution is made so as not to contain sulfuric acid except for sulfuric acid inevitably incorporated therein.

(Hexavalent Chromium Compound)

Examples of the hexavalent chromium compound include chromium trioxide ($CrO_3$), dichromates such as potassium dichromate ($K_2Cr_2O_7$), and chromates such as potassium chromate ($K_2CrO_4$).

The amount of Cr in the first aqueous solution is preferably not less than 0.14 mol/L and more preferably not less than 0.30 mol/L. At the same time, the amount of Cr is preferably not more than 3.00 mol/L and more preferably not more than 2.50 mol/L.

(Fluorine-Containing Compound)

Examples of the fluorine-containing compound include hydrofluoric acid (HF), potassium fluoride (KF), sodium fluoride (NaF), hydrosilicofluoric acid ($H_2SiF_6$), and/or salts thereof. Examples of salts of hydrosilicofluoric acid include sodium silicofluoride ($Na_2SiF_6$), potassium silicofluoride ($K_2SiF_6$), and ammonium silicofluoride ($(NH_4)_2SiF_6$).

The amount of F in the second aqueous solution is preferably not less than 0.010 mol/L and more preferably not less than 0.020 mol/L. With this, the uniformity of the chromium metal layer and the like improves.

Meanwhile, when the amount of F is too large in the second aqueous solution, the dissolution excessively proceeds, and this hinders the angulation of the granular protrusions. Accordingly, the amount of F in the second aqueous solution is preferably not more than 0.053 mol/L and more preferably not more than 0.048 mol/L.

(Sulfuric Acid)

The second aqueous solution is free of sulfuric acid. The sulfuric acid herein includes sulfates such as sodium sulfate, calcium sulfate, and ammonium sulfate.

In the meantime, sulfuric acid is inevitably incorporated in certain raw materials such as chromium trioxide in the industrial production process, so that the use of such raw materials results in inevitable incorporation of sulfuric acid into the resulting second aqueous solution.

In this case, the amount of $SO_4^{2-}$ in the second aqueous solution is preferably less than 0.0001 mol/L.

It is preferable that one type of aqueous solution be solely used in the second treatment (anodic electrolysis treatment A2, and cathodic electrolysis treatment C3).

The second aqueous solution has a solution temperature of preferably not lower than 20° C. and more preferably not lower than 30° C. At the same time, the solution temperature is preferably not higher than 80° C. and more preferably not higher than 60° C.

<<Anodic Electrolysis Treatment A2>>

The anodic electrolysis treatment A2 dissolves the granular protrusions deposited in the cathodic electrolysis treatment C2 to form starting points of angulation of the granular protrusions to be carried out in the subsequent cathodic electrolysis treatment C3.

In this process, when dissolution excessively proceeds in the anodic electrolysis treatment A2, too many starting points of angulation may be formed, and angular granular protrusions may not be obtained in some cases.

In view of the foregoing factor, the electric quantity density (the product of the current density and the current application time) in the anodic electrolysis treatment A2 is preferably not more than 1.3 C/dm$^2$, more preferably less than 1.0 C/dm$^2$, even more preferably not more than 0.5 C/dm$^2$, and particularly preferably not more than 0.1 C/dm$^2$.

The current density (unit: A/dm$^2$) and the current application time (unit: sec.) in the anodic electrolysis treatment A2 are appropriately set based on the foregoing electric quantity density.

<<Cathodic Electrolysis Treatment C3>>

As described above, cathodic electrolysis treatment allows chromium metal and a hydrated chromium oxide to be deposited. In particular, the cathodic electrolysis treatment C3 angulates the granular protrusions of the chromium metal layer.

In view of the foregoing factor, the current density of the cathodic electrolysis treatment C3 is preferably not less than 5.0 A/dm$^2$, more preferably not less than 10.0 A/dm$^2$, and even more preferably more than 15.0 A/dm$^2$.

The upper limit of the current density of the cathodic electrolysis treatment C3 is not particularly limited and is for instance not more than 80 A/dm$^2$ and preferably not more than 70.0 A/dm$^2$.

For the same reason, the electric quantity density (the product of the current density and the current application time) in the cathodic electrolysis treatment C3 is preferably not less than 3.5 C/dm$^2$, more preferably not less than 5.0 C/dm$^2$, and even more preferably not less than 10.0 C/dm$^2$.

The upper limit of the electric quantity density of the cathodic electrolysis treatment C3 is not particularly limited and is for instance not more than 35.0 C/dm$^2$ and preferably not more than 25.0 C/dm$^2$.

The current application time (unit: sec.) in the cathodic electrolysis treatment C3 is appropriately set based on the foregoing current density and electric quantity density.

The anodic electrolysis treatment A2 and the cathodic electrolysis treatment C3 need not be continuous electrolysis treatment. In other words, the treatments may be intermittent electrolysis treatment in which electrolysis is carried out separately for each set of electrodes in industrial production and, accordingly, an immersion time with no current application is inevitably present. In the case of intermittent electrolysis treatment, the total electric quantity density preferably falls within the foregoing range.

<Second Treatment (Second Embodiment)>

In the second treatment of the first embodiment described above, the anodic electrolysis treatment A2 is carried out at, for example, a relatively low electric quantity density to thereby moderately dissolve the granular protrusions before the cathodic electrolysis treatment C3 (i.e., angulation of the granular protrusions).

At this time, the anodic electrolysis treatment A2 is not necessarily required as long as the granular protrusions can be moderately dissolved before the cathodic electrolysis treatment C3.

Thus, in the second treatment of the second embodiment, the steel sheet having undergone the first treatment is subjected to the cathodic electrolysis treatment C3 using the second aqueous solution with no anodic electrolysis treatment A2.

Specifically, the steel sheet having undergone the first treatment is preferably subjected to immersion treatment using the second aqueous solution before the cathodic electrolysis treatment C3.

<<Second Aqueous Solution>>

The second aqueous solution used in the second treatment of the second embodiment is the same as that in the first embodiment and is therefore not described.

<<Immersion Treatment>>

When the immersion treatment is carried out, the steel sheet having undergone the first treatment is immersed in the second aqueous solution with no current being applied. The second aqueous solution contains a fluorine-containing compound. Hence, through immersion of the steel sheet having undergone the first treatment in the second aqueous solution, the granular protrusions deposited in the first treatment dissolve to form starting points of angulation of the granular protrusions to be carried out in the subsequent cathodic electrolysis treatment C3.

To dissolve the granular protrusions deposited in the first treatment, it is preferable to provide a certain length of immersion time. Specifically, the immersion time is preferably not less than 0.10 seconds, more preferably not less than 0.20 seconds, and even more preferably not less than 0.30 seconds.

However, when the immersion time is too long, too many starting points of angulation may be formed, and angular granular protrusions may not be obtained in some cases. Thus, the immersion time is preferably not more than 20.00 seconds, more preferably not more than 15.00 seconds, even more preferably not more than 10.00 seconds, and particularly preferably not more than 5.00 seconds.

<<Cathodic Electrolysis Treatment C3>>

The cathodic electrolysis treatment C3 carried out in the second treatment of the second embodiment is the same as that in the first embodiment and is therefore not described.

EXAMPLES

Aspects of the invention are specifically described below with reference to examples. However, the present invention should not be construed as being limited to the following examples.

<Manufacture of Steel Sheet for Cans>

A steel sheet produced with a sheet thickness of 0.22 mm (tempered grade: T4CA) was subjected to normal degreasing and pickling.

Subsequently, the steel sheet was subjected to the first treatment (cathodic electrolysis treatment C1, anodic electrolysis treatment A1, and cathodic electrolysis treatment C2) and the second treatment using the aqueous solutions shown in Table 1 below under the conditions shown in Tables 2 and 3. In Comparative Example 1, the second treatment was not carried out (the symbol "-" is placed in relevant spaces in Table 3 below).

Of examples in which the second treatment was carried out, in Inventive Example 2, the immersion treatment and the cathodic electrolysis treatment C3 were carried out, while in the other examples, the anodic electrolysis treatment A2 and the cathodic electrolysis treatment C3 were carried out (in Table 3 below, the symbol "-" is placed in those spaces corresponding to unperformed treatments).

In each treatment, the relevant aqueous solution was circulated in a flow cell at a 100 mpm equivalent speed with a pump, and lead electrodes were used.

Steel sheets for cans were thus manufactured. The manufactured steel sheets for cans were rinsed with water and dried by a blower at room temperature.

<Coating Weight and Others>

For each manufactured steel sheet for cans, the coating weight of the chromium metal layer and the coating weight of the hydrated chromium oxide layer in terms of chromium amount (stated simply as "Coating weight" in Table 4 below) were measured.

In addition, for granular protrusions of the chromium metal layer of each manufactured steel sheet for cans, the number density, the maximum particle size, and the proportion of granular protrusions with a circularity C of 0.85 or less (stated simply as "Proportion of circularity C of 0.85 or less in Table 4 below) were measured.

The measurement methods are as described above. The results are shown in Table 4 below.

<Evaluation>

The test described below was conducted on the manufactured steel sheets for cans to evaluate the weldability. The results are shown in Table 4 below.

<<Weldability>>

Each manufactured steel sheet for cans was subjected to heat treatment of 210° C.×10 minutes (i.e., retained at a target plate temperature of 210° C. for 10 minutes) three times, and then the contact resistance value was measured.

More specifically, two samples were taken from each steel sheet for cans and heated in a batch furnace, whereafter the two samples were superposed.

Subsequently, the superposed two samples were sandwiched by 1 mass % Cr—Cu electrodes of DR type (electrodes machined to a tip diameter of 6 mm and a curvature of R40 mm) and retained at a pressure of 1 kgf/cm 2 for 15 seconds.

Then, 10 A current was supplied thereto, and the resistance (unit: μΩ) between the two samples was measured. The measurement was made at ten points, the average thereof was taken as a contact resistance value, and the weldability was evaluated according to the following criteria. When the result is A, B, C, or D, the weldability can be rated as excellent.

A: Contact resistance value of not more than 20μΩ
B: Contact resistance value of more than 20μΩ but not more than 100 pc)
C: Contact resistance value of more than 100μΩ but not more than 300 pc)
D: Contact resistance value of more than 300μΩ but not more than 500 pc)
E: Contact resistance value of more than 500μΩ but not more than 1000 pc)
F: Contact resistance value of more than 1000μΩ

The structure of the hydrated chromium oxide layer is a structure in which chromium atoms are continuously bonded via oxo bonds and ol bonds. When the steel sheet for cans is subjected to heat treatment, a dehydration reaction of the hydrated chromium oxide layer proceeds, and ol bonds become oxo bonds. Typically, the higher the proportion of oxo bonds is, the more the insulation property of the hydrated chromium oxide layer increases.

While the heat treatment of 210° C.×10 minutes was carried out "two times" in Patent Literatures 1 and 2, the heat treatment was carried out "three times" in the present test to evaluate the weldability under stricter conditions.

TABLE 1

| Aqueous solution | Composition |
|---|---|
| A | $CrO_3$: 1.75 mol/L<br>$Na_2SiF_6$: 0.20 mol/L<br>$H_2SO_4$: 0.01 mol/L |
| B | $CrO_3$: 0.50 mol/L<br>$NH_4F$: 0.041 mol/L |
| C | $CrO_3$: 1.00 mol/L<br>$Na_2SiF_6$: 0.20 mol/L<br>$H_2SO_4$: 0.01 mol/L |
| D | $CrO_3$: 0.50 mol/L<br>NaF: 0.20 mol/L |

TABLE 2

| | First treatment | | | | | | | | | | |
|---|---|---|---|---|---|---|---|---|---|---|---|
| | | | Cathodic electrolysis treatment C1 | | | Anodic electrolysis treatment A1 | | | Cathodic electrolysis treatment C2 | | |
| | Aqueous solution | Temp ° C. | Current density A/dm$^2$ | Current application time sec. | Electric quantity density C/dm$^2$ | Current density A/dm$^2$ | Current application time sec. | Electric quantity density C/dm$^2$ | Current density A/dm$^2$ | Current application time sec. | Electric quantity density C/dm$^2$ |
| CE 1 | A | 45 | 30 | 0.70 | 21.0 | 1 | 0.50 | 0.5 | 30 | 0.70 | 21.0 |
| CE 2 | C | 45 | 30 | 1.00 | 30.0 | 1 | 0.50 | 0.5 | 30 | 0.25 | 7.5 |
| CE 3 | D | 45 | 60 | 0.65 | 39.0 | 1 | 0.50 | 0.5 | 60 | 0.15 | 9.0 |
| IE 1 | A | 45 | 30 | 0.70 | 21.0 | 1 | 0.50 | 0.5 | 30 | 0.70 | 21.0 |
| IE 2 | A | 45 | 30 | 0.70 | 21.0 | 1 | 0.50 | 0.5 | 30 | 0.70 | 21.0 |
| IE 3 | A | 45 | 30 | 0.70 | 21.0 | 1 | 0.50 | 0.5 | 30 | 0.70 | 21.0 |
| IE 4 | A | 45 | 30 | 0.70 | 21.0 | 1 | 0.50 | 0.5 | 30 | 0.70 | 21.0 |
| IE 5 | A | 45 | 30 | 0.70 | 21.0 | 1 | 0.50 | 0.5 | 30 | 0.70 | 21.0 |
| IE 6 | A | 45 | 30 | 0.70 | 21.0 | 1 | 0.50 | 0.5 | 30 | 0.70 | 21.0 |
| IE 7 | A | 45 | 30 | 0.70 | 21.0 | 1 | 0.50 | 0.5 | 30 | 0.70 | 21.0 |
| IE 8 | A | 45 | 30 | 0.70 | 21.0 | 1 | 0.50 | 0.5 | 30 | 0.70 | 21.0 |
| IE 9 | A | 45 | 30 | 0.70 | 21.0 | 1 | 0.50 | 0.5 | 30 | 0.70 | 21.0 |
| CE 4 | A | 45 | 30 | 0.70 | 21.0 | 1 | 0.50 | 0.5 | 30 | 0.70 | 21.0 |
| CE 5 | A | 45 | 30 | 0.70 | 21.0 | 1 | 0.50 | 0.5 | 30 | 0.70 | 21.0 |
| CE 6 | A | 45 | 30 | 0.70 | 21.0 | 1 | 0.50 | 0.5 | 30 | 0.70 | 21.0 |
| CE 7 | A | 45 | 30 | 0.70 | 21.0 | 1 | 0.50 | 0.5 | 30 | 0.70 | 21.0 |
| IE 10 | A | 45 | 30 | 0.70 | 21.0 | 1 | 0.50 | 0.5 | 30 | 0.70 | 21.0 |
| IE 11 | A | 45 | 30 | 0.70 | 21.0 | 1 | 0.50 | 0.5 | 30 | 0.70 | 21.0 |
| IE 12 | A | 45 | 30 | 0.70 | 21.0 | 1 | 0.50 | 0.5 | 30 | 0.70 | 21.0 |
| IE 13 | A | 45 | 30 | 0.70 | 21.0 | 1 | 0.50 | 0.5 | 30 | 0.70 | 21.0 |
| IE 14 | A | 45 | 30 | 0.70 | 21.0 | 1 | 0.50 | 0.5 | 30 | 0.70 | 21.0 |
| IE 15 | A | 45 | 30 | 0.70 | 21.0 | 1 | 0.50 | 0.5 | 30 | 0.70 | 21.0 |
| IE 16 | A | 45 | 30 | 0.70 | 21.0 | 1 | 0.50 | 0.5 | 30 | 0.70 | 21.0 |
| IE 17 | A | 45 | 30 | 0.70 | 21.0 | 1 | 0.50 | 0.5 | 30 | 0.70 | 21.0 |
| IE 18 | A | 45 | 30 | 0.70 | 21.0 | 1 | 0.50 | 0.5 | 30 | 0.70 | 21.0 |
| IE 19 | A | 45 | 30 | 0.70 | 21.0 | 1 | 0.50 | 0.5 | 30 | 0.70 | 21.0 |

CE: Comparative Example
IE: Inventive Example

TABLE 3

| | Second treatment | | | | | | | | |
|---|---|---|---|---|---|---|---|---|---|
| | | | Anodic electrolysis treatment A2 | | | Immersion | Cathodic electrolysis treatment C3 | | |
| | Aqueous solution | Temp. ° C. | Current density A/dm$^2$ | Current application time sec. | Electric quantity density C/dm$^2$ | treatment Immersion time sec. | Current density A/dm$^2$ | Current application time sec. | Electric quantity density C/dm$^2$ |
| CE 1 | — | — | — | — | — | — | — | — | — |
| CE 2 | C | 45 | 1.0 | 0.50 | 0.5 | — | 30.0 | 0.25 | 7.5 |
| CE 3 | D | 45 | 1.0 | 0.50 | 0.5 | — | 60.0 | 0.15 | 9.0 |
| IE 1 | B | 45 | 0.3 | 0.30 | 0.1 | — | 53.0 | 0.34 | 18.0 |
| IE 2 | B | 45 | — | — | — | 1.00 | 38.0 | 0.34 | 12.9 |
| IE 3 | B | 45 | 0.3 | 0.30 | 0.1 | — | 38.0 | 0.34 | 12.9 |
| IE 4 | B | 45 | 0.1 | 1.00 | 0.1 | — | 38.0 | 0.34 | 12.9 |
| IE 5 | B | 45 | 0.4 | 0.70 | 0.3 | — | 38.0 | 0.34 | 12.9 |
| IE 6 | B | 45 | 1.3 | 0.30 | 0.4 | — | 38.0 | 0.34 | 12.9 |
| IE 7 | B | 45 | 1.7 | 0.30 | 0.5 | — | 38.0 | 0.34 | 12.9 |
| IE 8 | B | 45 | 2.3 | 0.30 | 0.7 | — | 38.0 | 0.34 | 12.9 |
| IE 9 | B | 45 | 3.0 | 0.30 | 0.9 | — | 38.0 | 0.34 | 12.9 |
| CE 4 | B | 45 | 5.0 | 0.30 | 1.5 | — | 38.0 | 0.34 | 12.9 |
| CE 5 | B | 45 | 6.7 | 0.30 | 2.0 | — | 38.0 | 0.34 | 12.9 |
| CE 6 | B | 45 | 1.0 | 0.30 | 0.3 | — | 1.8 | 0.72 | 1.3 |
| CE 7 | B | 45 | 1.0 | 0.30 | 0.3 | — | 4.6 | 0.72 | 3.3 |
| IE 10 | B | 45 | 1.0 | 0.30 | 0.3 | — | 14.0 | 0.34 | 4.8 |
| IE 11 | B | 45 | 1.0 | 0.30 | 0.3 | — | 14.7 | 0.34 | 5.0 |
| IE 12 | B | 45 | 1.0 | 0.30 | 0.3 | — | 6.9 | 0.72 | 5.0 |
| IE 13 | B | 45 | 1.0 | 0.30 | 0.3 | — | 28.0 | 0.34 | 9.5 |
| IE 14 | B | 45 | 1.0 | 0.30 | 0.3 | — | 30.3 | 0.34 | 10.3 |
| IE 15 | B | 45 | 1.0 | 0.30 | 0.3 | — | 38.0 | 0.34 | 12.9 |
| IE 16 | B | 45 | 1.0 | 0.30 | 0.3 | — | 17.9 | 0.72 | 12.9 |
| IE 17 | B | 45 | 1.0 | 0.30 | 0.3 | — | 41.8 | 0.34 | 14.2 |
| IE 18 | B | 45 | 1.0 | 0.30 | 0.3 | — | 48.0 | 0.34 | 16.3 |
| IE 19 | B | 45 | 1.0 | 0.30 | 0.3 | — | 22.6 | 0.72 | 16.3 |

CE: Comparative Example
IE: Inventive Example

TABLE 4

| | Chromium metal layer | | | | Hydrated chromium oxide layer | |
|---|---|---|---|---|---|---|
| | | Granular protrusions | | | | |
| | Coating weight mg/m$^2$ | Proportion of circularity C of 0.85 or less % | Maximum particle size nm | Number density protrusions/μm$^2$ | Coating weight mg/m$^2$ | Evaluation Weldability |
| CE 1 | 109 | 12 | 120 | 70 | 6 | F |
| CE 2 | 110 | 15 | 120 | 40 | 7 | E |
| CE 3 | 135 | 10 | 65 | 300 | 4 | E |
| IE 1 | 151 | 73 | 160 | 77 | 14 | A |
| IE 2 | 130 | 77 | 130 | 67 | 14 | B |
| IE 3 | 127 | 68 | 120 | 66 | 12 | B |
| IE 4 | 127 | 62 | 110 | 80 | 11 | B |
| IE 5 | 126 | 59 | 130 | 40 | 13 | C |
| IE 6 | 123 | 51 | 110 | 60 | 12 | C |
| IE 7 | 120 | 48 | 100 | 74 | 12 | C |
| IE 8 | 110 | 31 | 120 | 71 | 13 | D |
| IE 9 | 125 | 25 | 110 | 78 | 11 | D |
| CE 4 | 111 | 19 | 110 | 70 | 11 | E |
| CE 5 | 109 | 16 | 100 | 72 | 11 | E |
| CE 6 | 110 | 15 | 100 | 73 | 22 | F |
| CE 7 | 112 | 18 | 100 | 68 | 17 | E |
| IE 10 | 114 | 22 | 100 | 70 | 13 | D |
| IE 11 | 121 | 44 | 100 | 82 | 13 | C |
| IE 12 | 121 | 28 | 110 | 74 | 12 | D |
| IE 13 | 123 | 53 | 110 | 69 | 13 | C |
| IE 14 | 124 | 61 | 120 | 78 | 12 | B |
| IE 15 | 128 | 64 | 110 | 72 | 12 | B |

TABLE 4-continued

| | Chromium metal layer | | | | Hydrated chromium oxide layer | |
|---|---|---|---|---|---|---|
| | | Granular protrusions | | | | |
| | Coating weight mg/m$^2$ | Proportion of circularity C of 0.85 or less % | Maximum particle size nm | Number density protrusions/μm$^2$ | Coating weight mg/m$^2$ | Evaluation Weldability |
| IE 16 | 126 | 57 | 90 | 69 | 12 | C |
| IE 17 | 129 | 67 | 100 | 62 | 11 | B |
| IE 18 | 135 | 72 | 120 | 71 | 13 | B |
| IE 19 | 136 | 70 | 130 | 83 | 12 | B |

CE: Comparative Example
IE: Inventive Example

<Summary of Evaluation Results>

As evident from the results shown in Tables 1 to 4 above, the weldability was good in Inventive Examples 1 to 19. In contrast, the weldability was insufficient in Comparative Examples 1 to 7.

Below described are details.

Comparative Example 1 is an example in which only the first treatment was carried out.

Comparative Example 2 is an example in which an aqueous solution C containing sulfuric acid was used as the second aqueous solution.

Comparative Example 3 is an example in which an aqueous solution D free of sulfuric acid was used as the first aqueous solution.

In all of those examples, the proportion of granular protrusions with a circularity C of 0.85 or less was less than 20%, and the weldability was insufficient.

Comparative Examples 4 and 5 are examples in which the electric quantity density of the anodic electrolysis treatment A2 was too high.

Comparative Examples 6 and 7 are examples in which the current density and the electric quantity density of the cathodic electrolysis treatment C3 were too low.

In all of those examples, the proportion of granular protrusions with a circularity C of 0.85 or less was less than 20%, and the weldability was insufficient.

As described above, all of Inventive Examples 1 to 19 demonstrated good weldability.

More specifically, the examples with the proportion of granular protrusions with a circularity C of 0.85 or less being not less than 20% and less than 40% were rated "D," the examples with the proportion being not less than 40% and less than 60% were rated "C," and the examples with the proportion being not less than 60% were rated "B" or "A."

In Inventive Example 1, while the proportion of granular protrusions with a circularity C of 0.85 or less was not less than 60% as with, for instance, Inventive Examples 2 to 4, the weldability was better than that in Inventive Examples 2 to 4. Presumably, this is because the maximum particle size of the granular protrusions in Inventive Example 1 was larger than that in Inventive Examples 2 to 4.

Inventive Example 2 is an example in which the second treatment of the second embodiment was carried out, and demonstrated a result comparable to those of, for example, Inventive Examples 3 and 4 in which the second treatment of the first embodiment was carried out.

Inventive Examples 3 to 9 differ only in the conditions (such as the electric quantity density) for the anodic electrolysis treatment A2. There has been a tendency that as the electric quantity density of the anodic electrolysis treatment A2 decreases, the proportion of granular protrusions with a circularity C of 0.85 or less increases, and the weldability improves.

Inventive Examples 10 to 19 differ only in the conditions (such as the electric quantity density) for the cathodic electrolysis treatment C3. There has been a tendency that as the electric quantity density of the cathodic electrolysis treatment C3 increases, the proportion of granular protrusions with a circularity C of 0.85 or less increases, and the weldability improves.

Compared to Inventive Example 12, Inventive Example 11 had the same electric quantity density of the cathodic electrolysis treatment C3 but a high current density of the cathodic electrolysis treatment C3. Presumably, this is the reason why Inventive Example 11 demonstrated a higher proportion of granular protrusions with a circularity C of 0.85 or less and better weldability than those in Inventive Example 12.

The same applies to Inventive Examples 15 and 16.

REFERENCE SIGNS LIST

1: steel sheet for cans
2: steel sheet
3: chromium metal layer
3*a*: base portion
3*b*: granular protrusion
4: hydrated chromium oxide layer

The invention claimed is:

1. A steel sheet for cans comprising, on a surface of a steel sheet, a chromium metal layer and a hydrated chromium oxide layer stacked in this order from a steel sheet side, wherein the chromium metal layer has a coating weight of 50 to 200 mg/m$^2$, the hydrated chromium oxide layer has a coating weight of 3 to 30 mg/m$^2$ in terms of chromium amount, the chromium metal layer includes a base portion of flat plate shape and granular protrusions provided on the base portion, and at least 20% of the granular protrusions has a circularity C of 0.85 or less, the circularity C being expressed by $C=4\pi A/U^2$, when an outer perimeter of a projection image of each of the granular protrusions is represented by U, and an area thereof is represented by A.

2. The steel sheet for cans according to claim 1, wherein the granular protrusions have a maximum grain size of not more than 200 nm, and the granular protrusions have a number density of not less than 10 protrusions/μm$^2$.

3. A method of manufacturing the steel sheet for cans according to claim 1, the method comprising:

subjecting the steel sheet to cathodic electrolysis treatment C1, anodic electrolysis treatment A1, and cathodic electrolysis treatment C2 in this order with use of a first aqueous solution, followed by anodic electrolysis treatment A2 and cathodic electrolysis treatment C3 with use of a second aqueous solution, wherein the first aqueous solution contains a hexavalent chromium compound, a fluorine-containing compound, and sulfuric acid, and the second aqueous solution contains a hexavalent chromium compound and a fluorine-containing compound and is free of sulfuric acid except for sulfuric acid inevitably incorporated therein.

4. The method according to claim 3, wherein an electric quantity density of the anodic electrolysis treatment A2 is not more than 1.3 $C/dm^2$.

5. A method of manufacturing the steel sheet for cans according to claim 1, the method comprising:

subjecting the steel sheet to cathodic electrolysis treatment C1, anodic electrolysis treatment A1, and cathodic electrolysis treatment C2 in this order with use of a first aqueous solution, followed by cathodic electrolysis treatment C3 with use of a second aqueous solution, wherein the first aqueous solution contains a hexavalent chromium compound, a fluorine-containing compound, and sulfuric acid, and the second aqueous solution contains a hexavalent chromium compound and a fluorine-containing compound and is free of sulfuric acid except for sulfuric acid inevitably incorporated therein.

6. The method according to claim 5, wherein immersion treatment is carried out with use of the second aqueous solution after the cathodic electrolysis treatment C2 and before the cathodic electrolysis treatment C3.

7. The method according to claim 6, wherein an immersion time of the immersion treatment is from 0.10 to 20.00 seconds.

8. The method according to claim 3, wherein a current density of the cathodic electrolysis treatment C3 is not less than 5.0 $A/dm^2$, and an electric quantity density of the cathodic electrolysis treatment C3 is not less than 3.5 $C/dm^2$.

9. The method according to claim 3, wherein an amount of F in the first aqueous solution is from 0.020 to 0.480 mol/L, and an amount of F in the second aqueous solution is from 0.010 to 0.053 mol/L.

10. The method according to claim 4, wherein a current density of the cathodic electrolysis treatment C3 is not less than 5.0 $A/dm^2$, and an electric quantity density of the cathodic electrolysis treatment C3 is not less than 3.5 $C/dm^2$.

11. The method according to claim 5, wherein a current density of the cathodic electrolysis treatment C3 is not less than 5.0 $A/dm^2$, and an electric quantity density of the cathodic electrolysis treatment C3 is not less than 3.5 $C/dm^2$.

12. The method according to claim 6, wherein a current density of the cathodic electrolysis treatment C3 is not less than 5.0 $A/dm^2$, and an electric quantity density of the cathodic electrolysis treatment C3 is not less than 3.5 $C/dm^2$.

13. The method according to claim 7, wherein a current density of the cathodic electrolysis treatment C3 is not less than 5.0 $A/dm^2$, and an electric quantity density of the cathodic electrolysis treatment C3 is not less than 3.5 $C/dm^2$.

14. The method according to claim 4, wherein an amount of F in the first aqueous solution is from 0.020 to 0.480 mol/L, and an amount of F in the second aqueous solution is from 0.010 to 0.053 mol/L.

15. The method according to claim 5, wherein an amount of F in the first aqueous solution is from 0.020 to 0.480 mol/L, and an amount of F in the second aqueous solution is from 0.010 to 0.053 mol/L.

16. The method according to claim 6, wherein an amount of F in the first aqueous solution is from 0.020 to 0.480 mol/L, and an amount of F in the second aqueous solution is from 0.010 to 0.053 mol/L.

17. The method according to claim 7, wherein an amount of F in the first aqueous solution is from 0.020 to 0.480 mol/L, and an amount of F in the second aqueous solution is from 0.010 to 0.053 mol/L.

18. The method according to claim 8, wherein an amount of F in the first aqueous solution is from 0.020 to 0.480 mol/L, and an amount of F in the second aqueous solution is from 0.010 to 0.053 mol/L.

19. The method according to claim 10, wherein an amount of F in the first aqueous solution is from 0.020 to 0.480 mol/L, and an amount of F in the second aqueous solution is from 0.010 to 0.053 mol/L.

20. The method according to claim 11, wherein an amount of F in the first aqueous solution is from 0.020 to 0.480 mol/L, and an amount of F in the second aqueous solution is from 0.010 to 0.053 mol/L.

21. The method according to claim 12, wherein an amount of F in the first aqueous solution is from 0.020 to 0.480 mol/L, and an amount of F in the second aqueous solution is from 0.010 to 0.053 mol/L.

22. The method according to claim 13, wherein an amount of F in the first aqueous solution is from 0.020 to 0.480 mol/L, and an amount of F in the second aqueous solution is from 0.010 to 0.053 mol/L.

* * * * *